US005460314A

United States Patent [19]

Udagawa

[11] Patent Number: 5,460,314

[45] Date of Patent: Oct. 24, 1995

[54] STAPLER WITH IMPROVED STAPLING PRECISION

[75] Inventor: Hiroshi Udagawa, Tokyo, Japan

[73] Assignee: Max Co., Ltd., Tokyo, Japan

[21] Appl. No.: 174,003

[22] Filed: Dec. 28, 1993

[30] Foreign Application Priority Data

Dec. 29, 1992 [JP] Japan ..... 4-093624
Dec. 29, 1992 [JP] Japan ..... 4-093625

[51] Int. Cl.[6] ..... B27F 7/17

[52] U.S. Cl. ..... 227/155; 227/131; 227/134

[58] Field of Search ..... 227/120, 130, 227/131, 155, 136, 134

[56] References Cited

U.S. PATENT DOCUMENTS

| | | | |
|---|---|---|---|
| 2,770,805 | 11/1956 | Elzer et al. | 227/131 |
| 3,625,408 | 12/1971 | Amakawa et al. | 227/131 |
| 3,698,616 | 10/1972 | Erhardt . | |
| 4,186,863 | 2/1980 | Yunoki | 227/131 |
| 4,199,095 | 4/1980 | Yamanoi | 227/155 |
| 4,421,264 | 12/1983 | Arter et al. . | |
| 4,592,651 | 6/1986 | Oikawa . | |
| 4,726,505 | 2/1988 | Okazaki | 227/120 |
| 4,988,029 | 1/1991 | Fiske . | |
| 5,005,751 | 4/1991 | Radtke . | |
| 5,009,355 | 4/1991 | Akizawa et al. | 227/131 |
| 5,195,671 | 3/1993 | Shimomura et al. | 227/120 |
| 5,269,451 | 12/1993 | Udagawa et al. | 227/120 |

FOREIGN PATENT DOCUMENTS

| | | |
|---|---|---|
| 0266700 | 5/1988 | European Pat. Off. . |
| 0475436 | 3/1992 | European Pat. Off. . |
| 0485846 | 5/1992 | European Pat. Off. . |
| 0496280 | 7/1992 | European Pat. Off. . |
| 0530857 | 3/1993 | European Pat. Off. . |
| 2219601 | 9/1990 | Japan . |
| 900005641 | 5/1990 | WIPO . |

*Primary Examiner*—Scott A. Smith
*Attorney, Agent, or Firm*—Cushman Darby & Cushman

[57] ABSTRACT

A stapler having improved stapling precision is provided. In a preferred embodiment, a stapler has a magazine with a staple driving unit, and a staple clinching unit wherein the magazine and the staple clinching unit are separately disposed. The magazine of the stapler is provided with a actuation linkage and guides which cause the magazine having the staple driving unit to consistently move in a substantially vertical direction with respect to the staple clinching unit, so that a staple driven thereby is driven in a direction substantially perpendicular to sheets of paper to be stapled, regardless of the thickness of the paper. In a variant of the preferred embodiment, the stapler is incorporated in another unit where the stapler is moved from one operating position to another. In order to maintain the alignment of the separately disposed magazine and staple clinching unit, alignment members are provided on either a frame supporting the magazine or a frame supporting the clinching unit, or on both. Accordingly, the present invention improves stapling precision and avoids poor quality stapling, especially due to poor alignment between the staple driving unit and the staple clinching unit.

15 Claims, 3 Drawing Sheets

STAPLER WITH IMPROVED STAPLING PRECISION

BACKGROUND OF THE INVENTION

1. Field of the Invention

The present invention relates to a stapler having a magazine with a staple driving unit, and a staple clinching unit which are mounted separately from one another. More specifically, the present invention relates to a magazine guide for consistently guiding the magazine in a direction substantially perpendicular to sheets of paper to be stapled. The present invention also relates to a stapler in which the magazine having the staple driving unit and the staple clinching unit are laterally moveable. The magazine with the staple driving unit and staple clinching unit must therefore be aligned to have assured stapling operation.

2. Description of Related Art

In general, in a conventional electrically operated stapler, a staple driving unit having a staple driving plate for driving a staple, and a staple clinching unit against which the legs of the driven staple are bent are pivotably connected at respective end portions opposite their operating ends. Therefore, a staple driving plate in the staple driving unit moves in an arc relative to the staple clinching unit during a stapling operation.

It can be understood that when a small thickness of paper is stapled, the staple driving plate is effectively perpendicular to the paper. Therefore, a staple can be assuredly driven through the paper in a direction substantially perpendicular to that of the paper.

But when a large thickness of paper is stapled, the staple driving plate approaches the surface of the paper at an angle which is no longer perpendicular to the paper. Therefore, a staple which is being driven becomes susceptible to bending and other unwanted distortion because the staple driving force is applied at an angle in this case.

When a conventional stapler of the above-described type is incorporated in a paper processing unit (e.g., a photocopier), sheets of paper are typically inserted between the staple driving unit and the staple clinching unit, stapled, then typically removed in a direction opposite the insertion direction. Therefore, it is necessary to provide a suitable mechanism for changing the sheet advancing direction, which makes the sheet conveying mechanism more complicated. In order to overcome this, the staple driving unit and the staple clinching unit may be separately disposed to allow the paper to move in a continuous direction therebetween. However, if the stapler must be moved, (e.g., to provide multiple staples for binding sheets of paper along a spine), the staple driving unit and the staple clinching unit must be properly aligned to permit proper stapling operation. Other, problems of poor stapling operation due to misalignment again occur.

SUMMARY OF THE INVENTION

It is therefore an object of the invention to provide a stapler which provides advantageously improved stapling precision. Specifically, a stapler according to the present invention has a magazine including a staple driving unit, and a staple clinching unit which are separately disposed from one another. The magazine is actuated (i.e., moved) by a linkage which is connected to an electric motor via reduction gears. The stapler is provided with mechanical guides so that the magazine having the staple driving unit moves is a substantially vertical direction with respect to the staple clinching unit. Accordingly, a staple is driven in a direction which is substantially perpendicular to a surface of paper to be stapled, regardless of the thickness of the paper.

In addition, in a stapler according to the present invention which is moved laterally during operation, such as in a photocopier, is provided with alignment members for maintaining a positional relationship between the staple driving unit and the staple clinching unit during movement so that assured staple operation can be attained.

Other objects, features, and characteristics of the present invention, as well as methods of operation and function of the related elements of structure, and the combination of parts and economies of manufacture, will become more apparent upon consideration of the following detailed description and the appended claims with reference to the accompanying drawings, all of which form a part of this specification.

DESCRIPTION OF THE PREFERRED EMBODIMENTS

Figure 1:
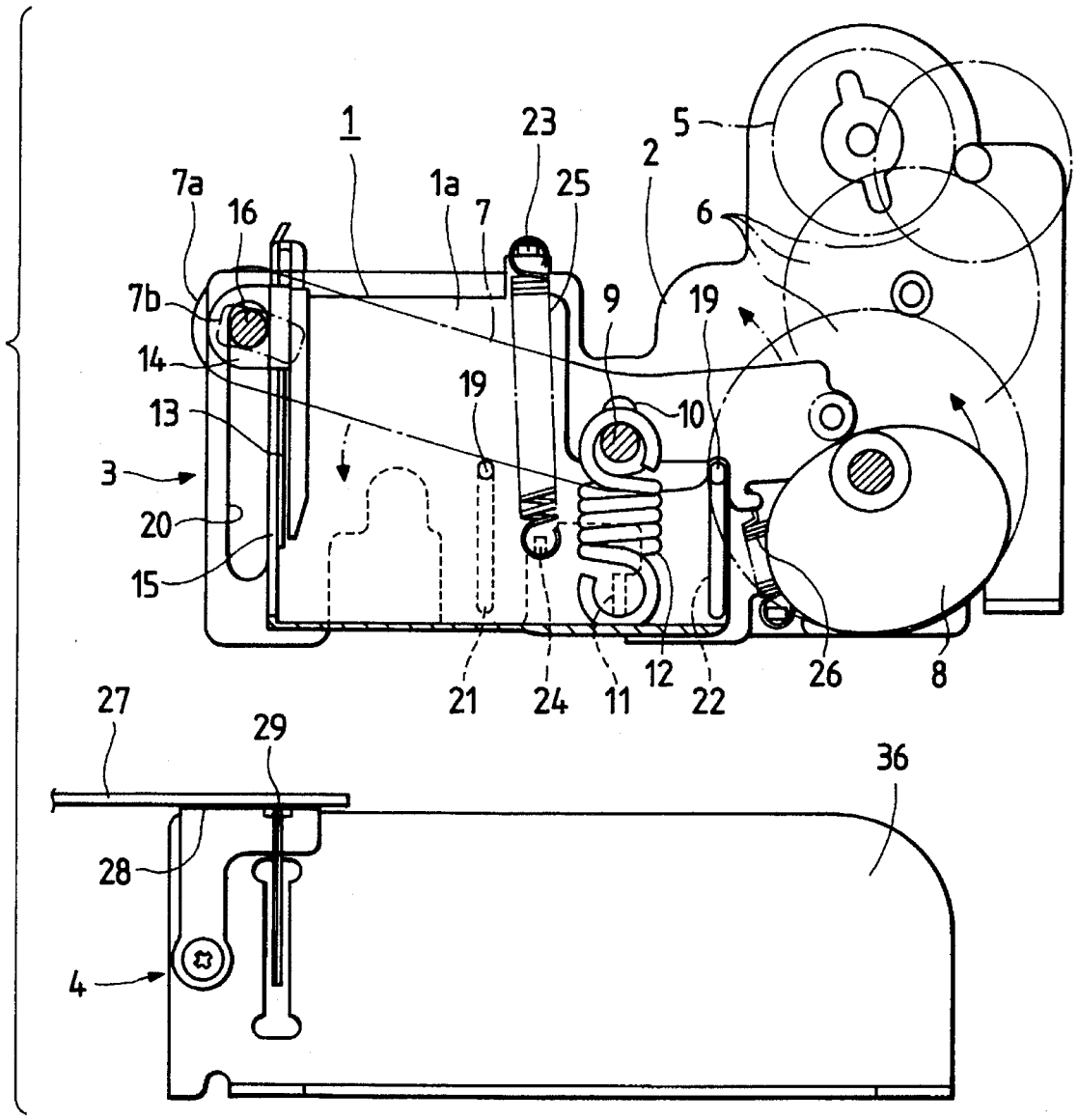
FIG. 1 is a side view of a stapler according to the present invention, prior to a stapling operation.

Referring to FIG. 1, a stapler according to the present invention includes a magazine 1 having a staple driving unit 3 supported by a frame 2 which are separated from a staple clinching section 4 for bending the legs of a staple driven by staple driving unit 3.

An electric motor 5 and reduction gears 6 connected to the electric motor 5 are disposed in frame 2. A drive link 7 is pivotably supported at an intermediate portion thereof by a pivot support shaft 9 which extends through elongate holes 10 in the side walls of frame 2. The holes 10 are longer in a vertical direction than a transverse. A rear end of the drive link 7 (i.e., opposite the staple driving plate) is operably engaged with a cam 8 connected to the final reduction gear of reduction gears 6. A front end of the drive link 7 is engaged with a front end of the staple driving unit 3 of the magazine 1. A paper thickness adjusting spring 12 extends between the support shaft 9 and a spring engaging piece 11 formed in a lower portion of the frame 2.

The magazine 1 has a magazine main body 1*a* which includes a staple accommodating section and the staple driving unit 3. The staple accommodating section comprises a detachable cartridge (not shown).

Since the structure of the staple accommodating section, and the mechanisms for conveying, forming, and driving the staples are the same as those of a conventionally operated stapler, only a brief explanation is offered here. Accordingly, in the drawings, only a staple driving plate 13 is illustrated.

A straight staple material is provided in sheet portions which are stacked in the detachable cartridge. In operation, a lower-most straight staple is conveyed from the cartridge to a forming plate (not shown) which forms the individual straight staple into a commonly recognized "C" shape. The forming plate and the staple driving plate 13 are connected by a protruding flange portion 14. Protruding flange portion 14 penetrates a slit 15 formed on the front wall of the magazine main body 1*a* so that protruding flange portion 14 projects forwardly. A fore end 7*a* of the drive link 7 has a slot 7*b* in which a connecting shaft 16 moves when drive link 7 pivots about support shaft 9. Connecting shaft 16 also extends through the protruding flange portion 14. When connecting shaft 16 moves, the staple driving plate 13 and the staple forming plate are moved along an inner surface of the front wall of the magazine main body 1*a* in frictional contact therewith.

The staple clinching unit 4 includes a stapling stand 28 mounted on a frame 36 on which a thickness of paper to be stapled is stacked. Stapling stand 28 has staple clinching groove 29 formed therein. The staple clinching groove 29 may be of a fixed type in which the clincher groove 29 is formed integrally with the stapling stand 28, or it may be a moveable type in which a staple leg is bent after it has penetrated the thickness of paper 27.

Figure 3:
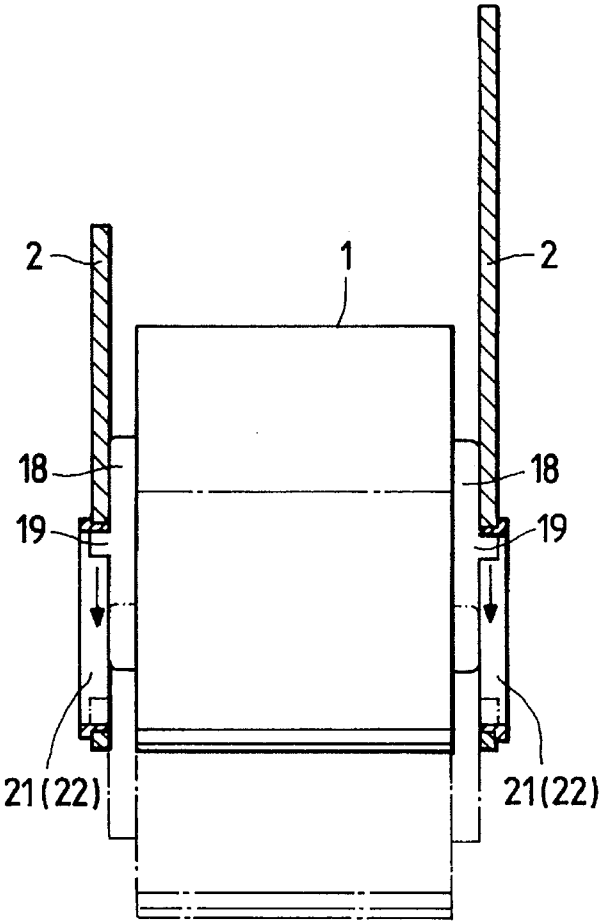
FIG. 3 is a front view of the stapler shown in FIGS. 1 and 2.
Figure 2:
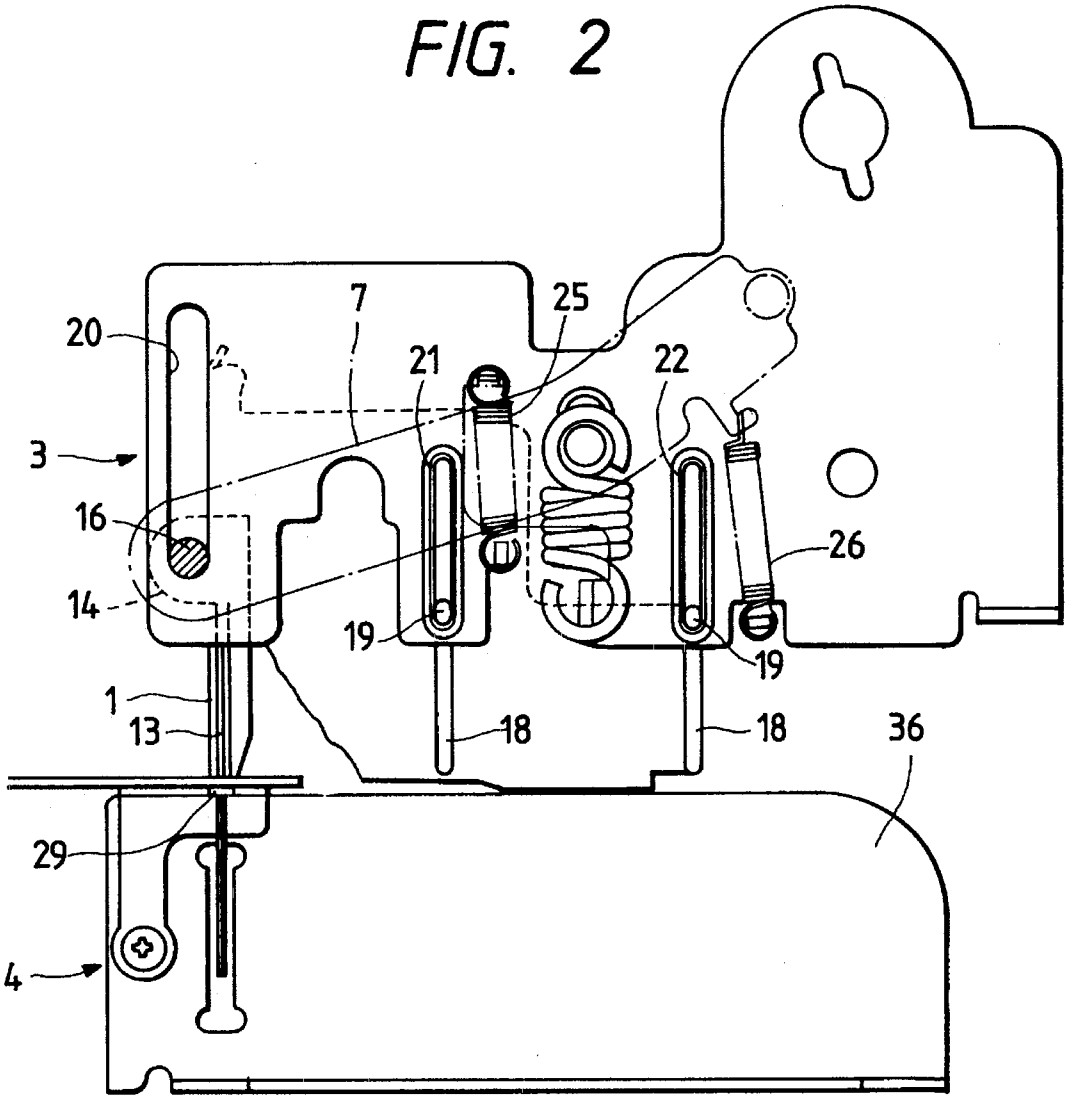
FIG. 2 is a side view of the stapler shown in FIG. 1, during a stapling operation.

Referring to FIG. 3, a guide mechanism for guiding the magazine 1 during the stapling operation is illustrated. More specifically, the sidewalls of the main magazine body 1*a* are provided with wing plates 18, each of which have at least one protrusion 19. Both sidewalls of frame 2 have substantially vertical guide slots, such as guide slots 20, 21, 22, at front, middle, and rear portions of the sidewalls of frame 2. As seen in FIG. 2, connecting shaft 16 and protruding portions 19 are slidably engaged in the guide slots 20, 21, and 22. In this manner, the magazine 1 is assuredly guided to move in a substantially vertical direction corresponding to the guide slots.

Other mechanisms may be provided to guide the magazine 1 in a vertical direction. For example (although not illustrated), c-shaped or cylindrical brackets may be provided on interior surfaces of the sidewalls of the frame 2 which can slidably engage with vertically oriented guide rods provided at the sides of the magazine 1.

In order to facilitate movement of the magazine 1 relative to the frame 2, a spring 25 is provided between an engaging portion 23 on the magazine main body 1*a* and an engaging portion 24 on the frame 2. As can be seen by comparing FIGS. 1 and 2, the action of the stretched spring 25 tends to force the main magazine body 1*a* downwardly towards the staple clinching unit 4. A rear end of the drive link 7 is forced downwardly under the influence of return spring 26, which in turn tends to raise the staple driving plate 13.

According to the structure described above, a thickness of paper 27 is inserted between the staple driving unit 3 and the staple clinching unit 4. Thereafter, electric motor 5 drives the cam 8 via reduction gears 6. The action of the cam 8 pushes upwardly on the end of the drive link 7 which is adjacent to the cam 8, thereby pivoting the drive link 7 about the support shaft 9. Accordingly, the front portion of the drive link 7 is forced downwardly, so that connecting shaft 16 is also driven downwardly (shown in FIG. 2). Therefore, the staple driving plate 13 is also forced downwardly. Concurrently, frictional effects between the staple driving unit 3 and the magazine main body 1*a* cause the magazine main body 1*a* to move vertically downward along guide slots 20, 21, and 22 substantially perpendicular to the thickness of paper 27. Staple drive plate 13 also moves perpendicularly to the paper 27. During the stapling operation, the rear portion of the magazine main body 1*a* is forced downward by spring 25, so that the front portion of the magazine main body 1*a*, which is in frictional contact with staple driving unit 3, cannot be independently moved downward. Otherwise, the magazine 1 would move downward in a slanted orientation. Therefore, the entire magazine main body 1*a* moves in a substantially vertical direction during the stapling operation.

In operation, the magazine 1 is lowered until it contacts the surface of the thickness of paper 27. Thereafter, staple driving plate 13 of the staple driving unit 3 is moved further downward to drive a staple so that its legs penetrate the paper 27. Then, the ends of the staple legs meet the staple clinching groove 29 and are bent thereagainst by continued force applied by the staple driving plate 13. This completes the process of stapling the paper 27.

After completing the stapling process, the drive link 7 is oppositely cycled by the operation of the cam 8. Accordingly, the magazine main body 1*a* is moved upward away from the staple clinching unit 4. Since the magazine main body 1*a* is forced downward by the spring 25, the staple driving plate 13 is first moved upwards, then the magazine main body 1*a* is moved upwards. The stapled sheets of paper 27 are thereafter discharged from between the staple driving unit 3 and the staple clinching unit 4.

Figure 4:
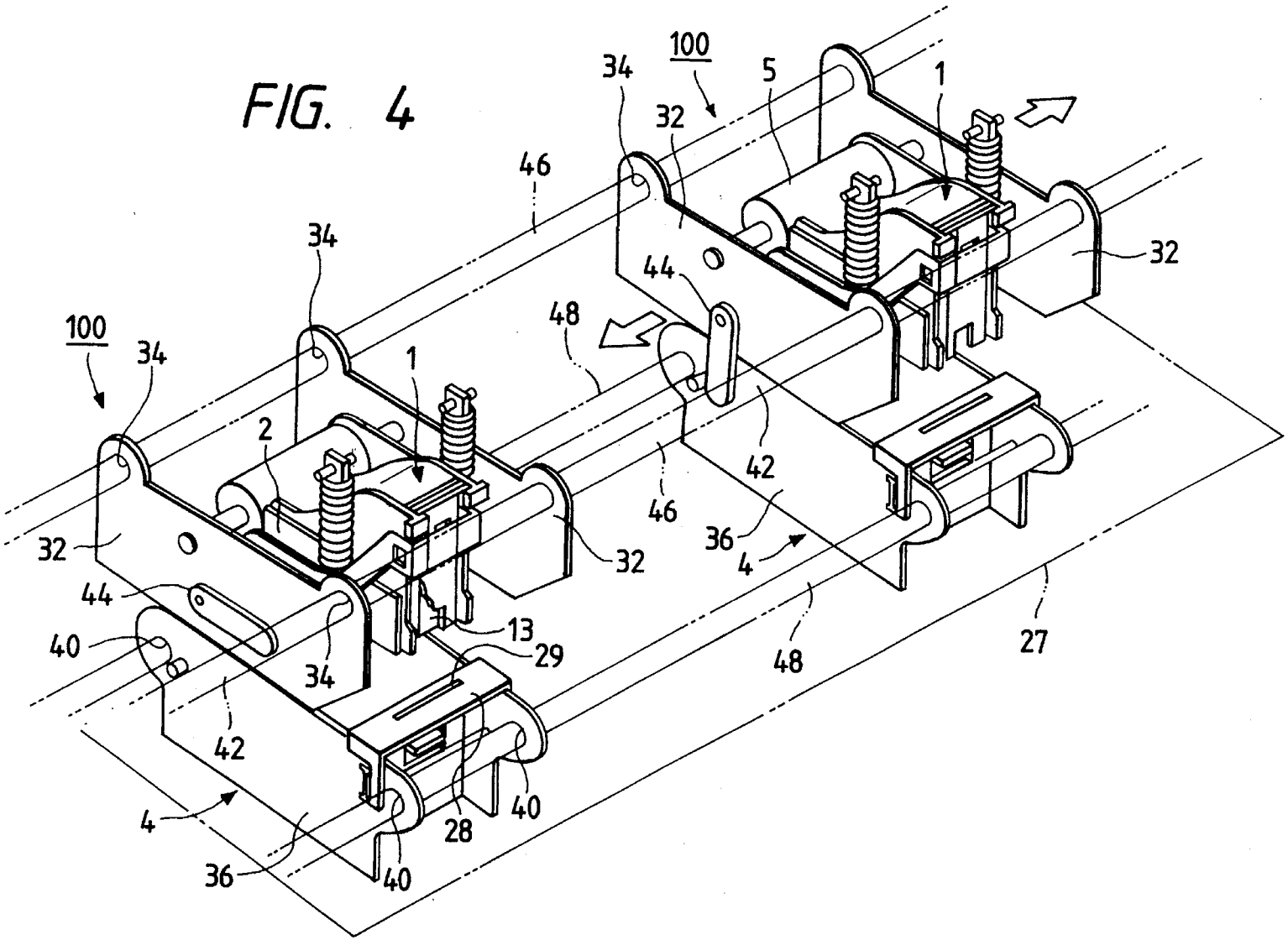
FIG. 4 is perspective view of a stapler according to the present invention movably incorporated in another apparatus.

In a variant of the above-described embodiment, a stapler, having the above-described structure and operation, may be movably incorporated into another piece of equipment, such as a photocopier, as illustrated in FIG. 4. The stapler, generally indicated at 100 in FIG. 4, has the same basic structure and operation as that of the first-described embodiment, based on a staple driving unit 3 and a staple clinching unit 4. Therefore, a detailed description of parts will be omitted where such would be repetitive, except to note that like reference numerals indicate like parts between the two variations.

The magazine 1 with staple driving unit 3 according to this embodiment is additionally provided with brackets 32 mounted on either side of the magazine 1. Brackets 32 have through holes 34.

The frame 36 of staple clinching unit 4 is provided with through holes 40.

Through holes 34 and 40 each slidably receive support rods 46 and 48, respectively. Support rods are fixedly mounted to support surfaces (not shown). Thus, the magazine 1 and staple clinching unit 4 can be moved along the support rods 46 and 48, respectively.

As noted above, because magazine 1 and staple clinching unit 4 are separate, and, as mounted on the support rods 46 and 48, are separately moveable, a pivotable alignment member 44 is provided on either the frame 32 or the frame 36, or on both the frame 32 and the frame 36 to hold the staple driving unit 3 and the staple clinching unit 4 aligned during movement of the stapler 100. If such alignment is not maintained, the stapler 100 disadvantageously becomes susceptible to poor stapling operation, typically evidenced by unwanted bending or distortion of staples during the stapling process. As seen in FIG. 4, alignment member 44 is shown pivotably attached to both portions of the frame 32, although the alignment member facing away from the reader cannot be seen in FIG. 4. As noted above, the alignment member 44 could instead be pivotably attached to the frame 36, or could be additionally pivotably attached to the frame 36. Likewise, the alignment member 44 may be mounted on interior or exterior surfaces of the frames 32, 36.

When alignment members 44 are not used, (during the stapling operation, for example), they are pivoted upwardly, as can be seen on the near stapler 100, with respect to the reader. When the alignment members 44 are engaged when the stapler 100 is moved, they are pivoted downward to engage with a guide surface 42 on the opposite frame, as seen on the far stapler 100, with respect to the reader's perspective.

Thus, the alignment members 44 can maintain a positional relationship between the magazine 1 with the staple driving unit 3 and the staple clinching unit 4 as the stapler 100 is moved along support rods 46, 48. When the movement of the stapler 108 is complete, the alignment members 44 may be moved out of a paper path in order to perform stapling. Accordingly, a thickness of paper 27 may be moved in a single direction between the staple driving unit 3 and staple clinching unit 4, instead of reversing direction, as noted in discussion of related art above.

It is emphasized that the specific structure of the alignment member 44 is not limited to the disclosure above. For example, an arm or pin may be moved axially to engage the guide surface 42 or a receiving hole appropriately disposed in the opposite frame portion. In addition, the movement of-the alignment member may be controlled, by a solenoid, for example, which actuates the alignment member according to whether the stapler 100 is being moved along the support rods or whether stapling is being performed. Such control can be accomplished by an controlling unit, such as a control unit within the photocopier in the above-described example, so that the stapling action and stapler movement can be coordinated with the photocopier operation.

According to the present invention, the magazine 1 is moved downward with respect to frame 2 along substantially vertical guide slots 20, 21, 22 in a direction which is substantially perpendicular to a thickness of paper 27. Accordingly, the staple driving plate 13 of the staple driving unit 3 is driven perpendicularly to the paper 27 regardless of its thickness. The core position of the driven staple therefore becomes consistent with respect to the paper 27. Consequently, an stapling operation can be performed with assuredly consistent results. When the stapler must be moved, (when it is incorporated into another apparatus, for example), alignment members are provided to maintain a stapling alignment between the staple driving unit and the staple clinching unit. Thus, assured stapling operation can be assuredly maintained with consistently good results.

While the present invention has been described in connection with what is presently believed to be the most practical and preferred embodiment, it is to be understood that the invention is not limited solely to the disclosed embodiment, but, on the contrary, is intended to cover various modifications and equivalent arrangements included within the spirit and scope of the claims appended hereto.

What is claimed:

1. A stapler for driving a staple having a penetrating portion, comprising:

a vertically moveable magazine body;

a staple driving unit disposed within said magazine body, said staple driving unit being in frictional contact with said magazine body; and a staple clinching portion independent of said magazine body and operably aligned with said magazine body.

2. A stapler according to claim 1, wherein said staple clinching portion comprises:

a base portion; and a staple clinching stand portion mounted on said base portion, said staple clinching stand portion being provided with clinching groove means against which the penetrating portion of the staple is bent.

3. A stapler according to claim 1, further comprising a magazine actuation mechanism for actuating said staple driving unit and for causing said magazine body to move in said substantially vertically direction.

4. A stapler according to claim 3, wherein said magazine actuation mechanism comprises:

a motor;

a plurality of engaging gears driven by said motor at a first gear thereof;

a cam connected to a final gear of said plurality of gears;

a pivotable drive link which is moveable according to the action of the cam, said pivotable drive link being connected at a first end to said staple driving unit, whereby the motion of said drive link actuates said staple driving unit;

first elastic means for providing a downward force on a second end of a said drive link opposite said first end; and second elastic means for providing a downward force on said magazine body.

5. A stapler according to claim 1, wherein said staple driving unit includes a staple driving plate.

6. A stapler according to claim 1, wherein said vertically moveable magazine body is disposed in a frame, said magazine body being vertically moveable relative to said frame.

7. A stapler according to claim 6, wherein said frame has at least one means for guiding said magazine body in a vertical direction relative to said frame.

8. A stapler according to claim 7, wherein said means for guiding comprises a protrusion provided on said magazine body which is engageable with a slot formed in said frame.

9. A stapler according to claim 1, wherein said magazine body and said staple clinching portion are moveable along a lateral direction.

10. A stapler according to claim 9, wherein said magazine body and said staple clinching portion are independently moveable along a lateral direction.

11. A stapler according to claim 10, further comprising means for aligning said magazine body and said staple clinching body when said magazine body and said staple clinching body are laterally moved.

12. A stapler according to claim 11, wherein said means for aligning comprises at least one selectively actuatable member for engaging said magazine body and said staple clinching portion.

13. A stapler according to claim 1, wherein the movement of said magazine body is restrained to rectilinear translatory motion.

14. A stapler according to claim 1, wherein a feed path for material to be stapled lies along a lateral direction relative to the stapler.

15. A stapling device comprising a plurality of stapling units, each said stapling unit comprising:

a vertically moveable magazine body, including a staple driving unit disposed within said magazine body in frictional contact therewith; and a staple clinching portion independent of said magazine body and operably aligned therewith, wherein said magazine body and said staple clinching portion are each movably mounted on at least one respective guide member along a lateral line of travel, each said stapling unit being provided with means for maintaining an operative alignment between said magazine body and said staple clinching portion during movement along the lateral line of travel, said plurality of stapling units collectively having a stapling path therethrough parallel to the lateral line of travel.

* * * * *